US011305977B2

(12) United States Patent
O'Nan et al.

(10) Patent No.: US 11,305,977 B2
(45) Date of Patent: Apr. 19, 2022

(54) CONTAINER-FILLING SYSTEM

(71) Applicant: Berry Global, Inc., Evansville, IN (US)

(72) Inventors: David Y. O'Nan, Henderson, KY (US); David C. Arnold, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 50 days.

(21) Appl. No.: 16/788,376

(22) Filed: Feb. 12, 2020

(65) Prior Publication Data

US 2020/0255278 A1 Aug. 13, 2020

Related U.S. Application Data

(60) Provisional application No. 62/804,277, filed on Feb. 12, 2019.

(51) Int. Cl.
*B67D 1/08* (2006.01)

(52) U.S. Cl.
CPC ..... *B67D 1/0888* (2013.01); *B67D 1/0894* (2013.01)

(58) Field of Classification Search
CPC ... B67D 1/0888; B67D 1/0892; B67D 1/0894
See application file for complete search history.

(56) References Cited

U.S. PATENT DOCUMENTS 4,951,719 A * 8/1990 Wiley ..... B67D 1/0041 141/1
4,975,568 A * 12/1990 Taniguchi ..... G01N 21/9027 250/223 B
5,139,406 A * 8/1992 Hoshino ..... B29C 49/78 250/223 B
6,053,359 A * 4/2000 Goulet ..... G07F 13/10 221/221
6,993,176 B2 * 1/2006 Yamagishi ..... G01F 23/292 250/223 B
7,354,538 B2 * 4/2008 Semersky ..... B29C 49/78 264/40.1
8,867,045 B2 * 10/2014 Piana ..... G01V 8/20 356/614
9,141,562 B2 * 9/2015 Pickett ..... B65B 7/2807
10,239,742 B2 * 3/2019 Dresser ..... B67D 1/0888
10,689,240 B1 * 6/2020 Schultz ..... B67D 1/0041
2013/0220480 A1 * 8/2013 Angus ..... B67D 1/124 141/9
2013/0282164 A1 * 10/2013 Veloo ..... G07F 13/10 700/216

(Continued)

OTHER PUBLICATIONS

Dreamakerdave, "McDonald's Drink Dispenser" video, available at https://www.youtube.com/watch?v=akv4vSXa5a4, May 7, 2015.

(Continued)

*Primary Examiner* — Timothy L Maust
(74) *Attorney, Agent, or Firm* — Barnes & Thornburg LLP

(57) ABSTRACT

A container-filling system includes a product-dispenser system and a control system. The product-dispenser system includes a conveyor defining a predetermined path, a container loader, and a container filler. The predetermined path has a sensing station, a loading station, and a filling station. The control system determines if a container is present at the sensing station. The cup loader provides a container at the loading station. The cup filler dispenses a product into the container at the filling station.

20 Claims, 10 Drawing Sheets

(56) References Cited

U.S. PATENT DOCUMENTS

| | | | | |
|---|---|---|---|---|
| 2019/0352161 | A1* | 11/2019 | Knight | B67D 1/0034 |
| 2020/0260906 | A1* | 8/2020 | Thompson | A47J 31/4425 |
| 2020/0307983 | A1* | 10/2020 | Checchinato | A47J 31/46 |

OTHER PUBLICATIONS

Panasonic, Ultra-slim Photoelectrid Sensor EX-10 Series Ver. 2, available at least on Sep. 23, 2020, 14 pages.

Lyondellbasell, Pro-fax RP448S, available from: https://www.lyondellbasell.com/en/polymers/p/Pro-fax-RP448S/55476465-e079-4f0c-b28e-909a730f32be, available at least by Dec. 25, 2019, 5 pages.

* cited by examiner

CONTAINER-FILLING SYSTEM

PRIORITY CLAIM

This application claims priority under 35 U.S.C. § 119(e) to U.S. Provisional Application Ser. No. 62/804,277, filed Feb. 12, 2019, which is expressly incorporated by reference herein.

BACKGROUND

The present disclosure relates to a container-filling system, and particularly to an automatic container-filling system. More particularly, the present disclosure relates to a container-filling system configured for use with cups and beverages.

SUMMARY

A container-filling system, in accordance with the present disclosure, includes a product-dispenser system and a control system coupled to the product-dispenser system. The product-dispenser system is configured to position automatically at least one container in a container holder and fill the container with a product. The control system is configured to determine if a container is present in the container holder and command the product-dispenser system to provide a container for filling if no container is already present in the container holder.

In illustrative embodiments, the container-filling system further includes a filter for use with relatively transparent containers. The filter is configured to mate with the container holder and is configured to interact with the control system so that the control system can determine if a relatively transparent container is present in the container holder.

In illustrative embodiments, the control system includes a sensor unit and a controller. The sensor unit is configured to emit a sensor beam toward the container holder and generate a sensor signal when a container is absent. The controller is configured to receive the sensor signal and send a command signal to the product-dispenser system to cause the product-dispenser system to provide a container for filling.

In illustrative embodiments, the filter includes a carrier and a coating disposed on an outer surface of the carrier. The carrier is injection molded with a clarified plastics material. The coating includes a metallic base that is configured to interact with the sensor beam produced by the sensor unit to block the sensor beam when a relatively transparent container is present in the container holder.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective and diagrammatic view of a container-filling system, in accordance with the present disclosure, including a product-dispenser system that is configured to automatically load and fill at least one container at a time and a plurality of container holders configured to travel along a predetermined path that includes a sensing station, where the system determines if the container holder is empty, a loading station, where a container is loaded into the container holder, and a filling station, where the container is filled with a product;

DETAILED DESCRIPTION

Figure 1:
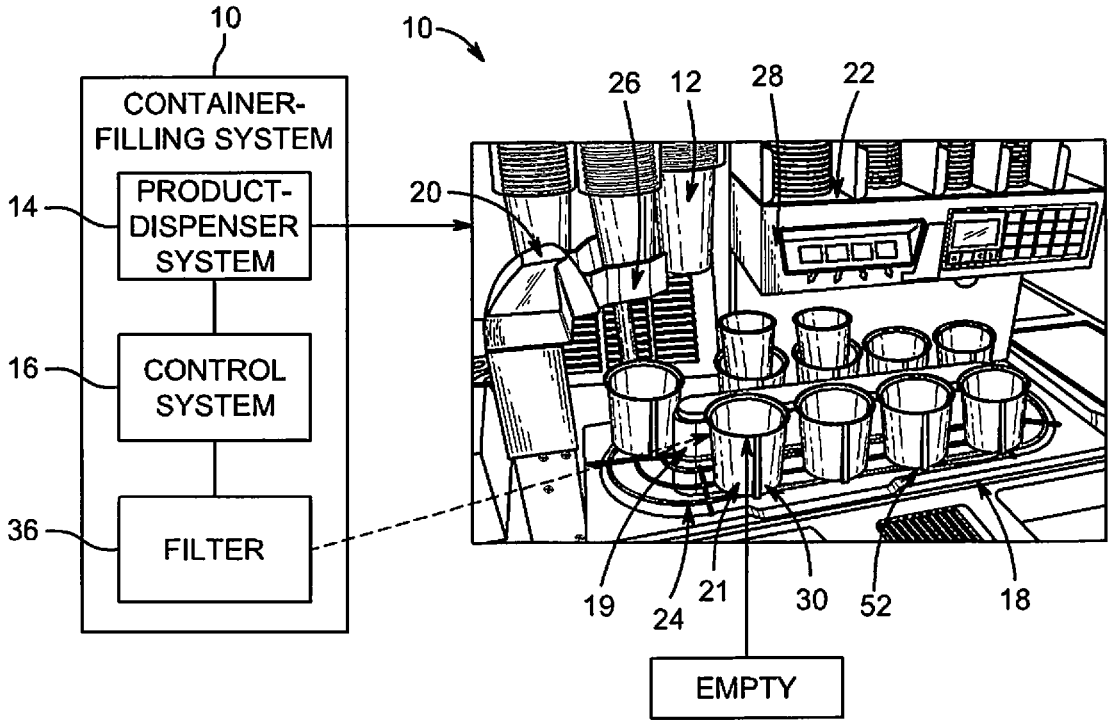

A container filling system 10, in accordance with the present disclosure, is shown in FIG. 1. The container filling system 10 is configured to automatically position and fill containers 12 with a product, such as a liquid beverage, as suggested in FIGS. 1 and 15-19. The container filling system 10 includes a product-dispenser system 14, a control system 16, and a filter 36 coupled to the product-dispenser system 14. The product-dispenser system 14 is configured to ready at least one container 12 in a container holder 21 for filling and dispensing the product into the container to provide a final package for use. The control system 16 is configured to determine if a container 12 is present in the container holder and command the product-dispenser system 14 to dispense a single container into an empty container holder 21 for filling if there is no container already present. The filter 36 is configured to interact with a sensor beam 33 produced by the control system 16, as suggested in FIGS. 4-8, so that the container-filling system 10 is operable with relatively transparent cups.

The product-dispenser system 14 includes a conveyor 18, a container loader 20, and a container filler 22 as shown in FIG. 1. The conveyor 18 includes a track 19 and a plurality of container holders 21 positioned along the track 19. The container holders 21 are configured to travel along a predetermined path 24 around the track 19 in one direction, which is clockwise in the illustrative embodiment. The predetermined path 24 has a loading station 26 and a filling station 28 downstream of the loading station 26 along the conveyor 18. The container loader 20 is configured to dispense a container 12 into the container holder 21 at the loading station 26. The containers 12 travel along the predetermined path 24 from the loading station 26 to the filling station 28 where the container filler 22 is configured to dispense the product into the container to provide the final package.

Figure 2:
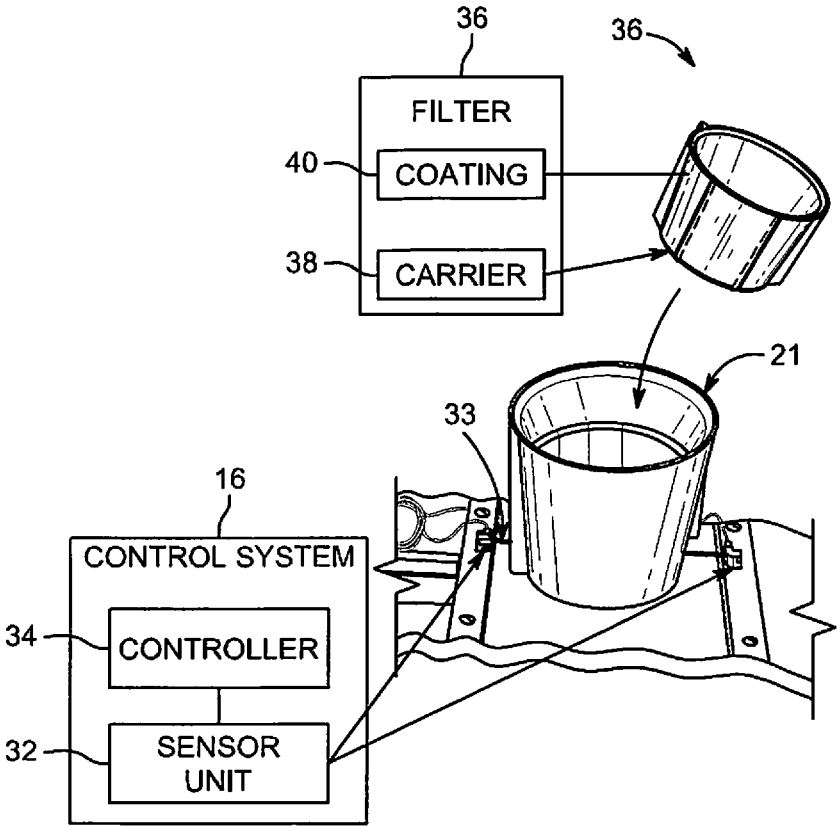
FIG. 2 is a perspective view of a single container holder from FIG. 1 and a filter included in the container-filling system suggesting that the filter is sized and shaped to fit into the container holder to allow the system to sense a wide variety of containers at the sensing station.

The predetermined path 24 further includes a sensing station 30 upstream of the loading station 26 where the control system 16 is configured to determine if the container holder 21 is empty and should receive a container 12. The control system 16 includes a sensor unit 32 and a controller 34 as shown in FIG. 2. The sensor unit 32 is configured to emit a sensor beam 33 toward one of the container holders 21 at the sensing station 30 and generate a sensor signal when the container 12 is either present or absent from the container holder 21. In the illustrative embodiment, the sensor unit 32 sends the sensor signal to the controller 34 when no container is present at the sensing station 30. Upon receipt of the sensor signal, the controller 34 is configured send a command signal to the product-dispenser system 14 to command the container loader 20 to dispense a container 12 into the empty container holder 21. In another example, when the sensor unit 32 does not send the sensor signal, the controller 34 will send a command signal to the conveyor 18 to halt movement of the cup holders 21 along the predetermined path 24. In another example, the loading, filling, and sensing stations 26, 28, 30 are all at the same location.

The container-filling system 10 is adapted to be used with a wide variety of containers 12 having a relatively high transparency. In an illustrative embodiment, the containers 12 are relatively high transparency cups. The cups 12 are at least partially transparent and have an alpha value that is less than 1 as suggested in FIG. 3. The filter 36 is configured to interact with the sensor beam 33 to cause the sensor unit 32 to sense the presence, or lack thereof, of an at least partially transparent cup 12 within the container holder 21, also called cup holder 21.

The clarity of cup 12 as discussed herein is measured using ASTM D 1746 which is hereby incorporated by reference herein in its entirety. In some examples, the clarity of cup 12 is in a range of about 40% to about 95%. In some examples, the clarity of cup 12 is in a range of about 50% to about 95%. In some embodiments, the clarity of cup 12 is in a range of about 55% to about 95%. In some embodiments, the clarity of cup 12 is in a range of about 60% to about 95%. In some embodiments, the clarity of cup 12 is in a range of about 55% to about 65%. In some embodiments, the clarity of cup 12 is in a range of about 65% to about 75%. In some embodiments, the clarity of cup 12 is in a range of about 70% to about 95%. In some embodiments, the clarity of cup 12 is in a range of about 70% to about 90%. In some embodiments, the clarity of cup 12 is in a range of about 70% to about 85%. In some embodiments, the clarity of cup 12 is in a range of about 70% to about 80%. In some embodiments, the clarity of cup 12 is in a range of about 65% to about 85%.

In illustrative embodiments, the clarity of cup 12 is greater than about 70%. In some embodiments, the clarity of cup 12 is greater than about 60%. In some embodiments, the clarity of cup 12 is greater than about 65%. In some embodiments, the clarity of cup 12 is greater than about 75%. In some embodiments, the clarity of cup 12 is greater than about 80%. In some embodiments, the clarity of cup 12 is greater than about 90%.

In some examples, the clarity of cup 12 is about 56.2%. In some examples, the clarity of cup 12 is about 58.5%. In some examples, the clarity of cup 12 is about 63.7%. In some examples, the clarity of cup 12 is about 60.2%. In some examples, the clarity of cup 12 is about 70.2%. In some examples, the clarity of cup 12 is about 80.9%. In some examples, the clarity of cup 12 is about 94.8%. In some examples, the clarity of cup 12 is about 74.2%. In some examples, the clarity of cup 12 is about 71.2%. In some examples, the clarity of cup 12 is about 70.3%. In some examples, the clarity of cup 12 is about 65.8%.

The haze of cup 12 as discussed herein is measured using ASTM D 1003 procedure B which is hereby incorporated by reference herein in its entirety. In some examples, the haze of cup 12 is in a range of about 10% to about 60%. In some examples, the haze of cup 12 is in a range of about 10% to about 40%. In some examples, the haze of cup 12 is in a range of about 20% to about 38%. In some examples, the haze of cup 12 is in a range of about 20% to about 40%. In some examples, the haze of cup 12 is in a range of about 30% to about 40%. In some examples, the haze of cup 12 is in a range of about 14% to about 25%. In some examples, the haze of cup 12 is in a range of about 0% to about 30%. In some examples, the haze of cup 12 is in a range of about 10% to about 30%. In some examples, the haze of cup 12 is in a range of about 20% to about 28%.

In illustrative embodiments, the haze of cup 12 is less than about 30%. In some embodiments, the haze of cup 12 is less than about 29%. In illustrative embodiments, the haze of cup 12 is less than about 28%. In illustrative embodiments, the haze of cup 12 is less than about 40%. In illustrative embodiments, the haze of cup 12 is less than about 20%. In illustrative embodiments, the haze of cup 12 is less than about 7%.

In some examples, the haze of cup 12 is about 36.9%. In some examples, the haze of cup 12 is about 23.0%. In some examples, the haze of cup 12 is about 21.5%. In some examples, the haze of cup 12 is about 20.2%. In some examples, the haze of cup 12 is about 23.5%. In some examples, the haze of cup 12 is about 18.8%. In some examples, the haze of cup 12 is about 14.1%. In some examples, the haze of cup 12 is about 28.3%. In some examples, the haze of cup 12 is about 31.4%. In some examples, the haze of cup 12 is about 32.4%. In some examples, the haze of cup 12 is about 32.8%. In some examples, the clarity of cup 12 is greater than about 70% and the haze is less than about 30%. In some examples, the clarity of cup is about 74.2% and the haze is about 28.3%.

In one example, the formulation comprises materials described in U.S. Patent Publication No. 2017/0251852, which is expressly incorporated by reference herein in its entirety. The formulation may comprise a first polypropylene resin which is a homopolymer polypropylene resin. In another example, the formulation includes a first polypropylene resin and a second polypropylene resin. In another example, the formulation includes a first polypropylene resin, a second polypropylene resin, and a third polypropylene resin. In some examples, the first polypropylene resin may be a polypropylene homopolymer, the second polypropylene resin may be an impact polypropylene copolymer, and the third polypropylene may be a polypropylene random copolymer. In another example, the first polypropylene resin may be an impact polypropylene copolymer and the second polypropylene resin may be an impact polypropylene copolymer including a mineral. In another example, the first polypropylene resin may be an impact polypropylene copolymer and the second polypropylene resin may be an impact polypropylene copolymer including calcium carbonate. The first polypropylene resin may be a polypropylene homopolymer and the second polypropylene resin may be an impact polypropylene copolymer.

In some examples, the amount, by weight percentage of the formulation, of the first polypropylene resin may be selected from a first series of ranges of about 70% to about 100 wt %, about 75% to about 100%, about 85% to about 100%, about 90% to about 100%, and about 95% to about 100%. In some examples, the amount, by weight percentage of the formulation, of the first polypropylene resin may be selected from a second series of ranges of about 70% to about 95 wt %, about 70% to about 90%, about 70% to about 85%, about 70% to about 80%, and about 70% to about 75%. In some examples, the amount, by weight percentage of the formulation, of the first polypropylene resin may be selected from a third series of ranges of about bout 75% to about 95 wt %, about 80% to about 90%, and about 79% to about 91%. In some examples, the amount, by weight percentage of the formulation, of the first polypropylene resin may be selected from a first series of values of about 70%, about 75%, about 80%, about 85%, about 90%, about 95%, and about 100%.

In some examples, the amount, by weight percentage of the formulation, of the second polypropylene resin may be selected from a first series of ranges of about 0% to about 20 wt %, 0% to about 15%, 0%, to about 10%, and about 0% to about 5%. In some examples, the amount, by weight percentage of the formulation, of the second polypropylene resin may be selected from a second series of ranges of about 0% to about 20 wt %, about 5% to about 20%, about 10% to about 20%, and about 15% to about 20%. In some examples, the amount, by weight percentage of the formulation, of the second polypropylene resin may be selected from a third series of ranges of about 0% to about 10 wt %, about 1% to about 9%, about 2% to about 8%, about 3% to about 7%, and about 4% to about 6%. In some examples, the amount, by weight percentage of the formulation, of the second polypropylene resin may be selected from a first series of values of about 1%, about 2%, about 3%, about 4%, about 5%, about 6%, about 7%, about 8%, and about 9%.

In some examples, the amount, by weight percentage of the formulation, of the third polypropylene resin may be selected from a first series of ranges of about 0% to about 20 wt %, 0% to about 15%, 0%, to about 10%, and about 0% to about 5%. In some examples, the amount, by weight percentage of the formulation, of the third polypropylene resin may be selected from a second series of ranges of about 0% to about 20 wt %, about 5% to about 20%, about 10% to about 20%, and about 15% to about 20%. In some examples, the amount, by weight percentage of the formulation, of the third polypropylene resin may be selected from a third series of ranges of about 0% to about 20 wt %, about 2% to about 18%, about 4% to about 16%, about 6% to about 14%, about 8% to about 12%, and about 7% to about 13%. In some examples, the amount, by weight percentage of the formulation, of the third polypropylene resin may be selected from a first series of values of about 2%, about 4%, about 6%, about 8%, about 10%, about 12%, about 14%, about 16%, about 18%, and about 20%.

The filter includes a carrier 38 and may include a coating 40 disposed on the carrier 38. The carrier 38 forms a base for the coating 40 and is configured to hold the coating 40 relative to the sensor unit 32. The coating 40 is disposed on the carrier 38 in a location that is aligned with the sensor unit 32 and the sensor beam 33 when the filter 36 is at the sensing station 30. The coating 40 comprises a metallic material that is configured to filter the sensor beam 33 prior to the sensor beam 33 reaching the cup 12.

The carrier 38 and the coating 40 provide means for filtering the sensor beam 33 when the cup holder 21 and the cup 12 are at the sensing location 30 so that the sensor unit 32 senses the presence of the cup 12 in the cup holder 21. If a cup 12 is determined to be present in the cup holder 21, the controller 34 does not instruct the cup loader 20 to dispense a cup into the cup holder 21 at the loading station 26.

Figure 3:
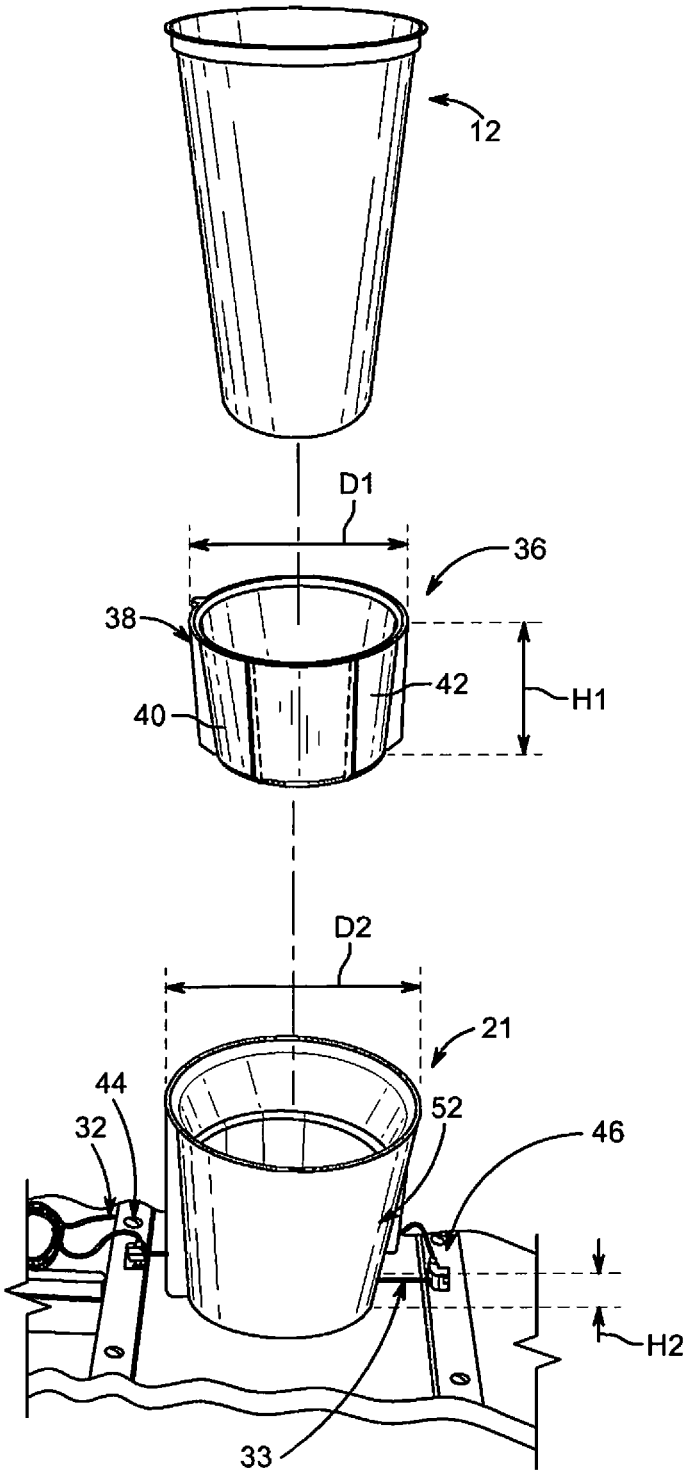
FIG. 3 is a perspective view of a single container holder with the filter and a container with a relatively-high transparency removed from the insert.

The carrier 38 is illustratively embodied as an insert that is coupled to each of the cup holders 21 so that the filter 36 retrofits an existing container-filling system 10 for use with the relatively transparent cups 12 as shown in FIG. 3. The carrier 38 is constructed of a polymeric material such as, for example, an injection molding grade, clarified polypropylene, acrylic, or another relatively transparent polymer material. In one example, the carrier 38 is formed from a clarified polypropylene material such as Pro-fax RP448S manufactured by LyondellBasell Industries®.

The carrier 38 has a shape that corresponds to the cup holder 21 as shown in FIGS. 2 and 3. The carrier 38 has a first diameter D1 while the cup holder 21 has a second diameter D2 that is slightly greater than the first diameter D1 such that the carrier 38 is sized to fit within the cup holder 21. The carrier 38 is configured to slide into the cup holder 21 and bet retained in the cup holder by a snap retainer, a friction fit due to the size of the first and second diameters D1 and D2 relative to one another, any other suitable alternative, or combinations thereof. The carrier 38, and therefore the filter 36, may be removed from the cup holders 21 when relatively transparent cups 12 are not being used.

Although the carrier 38 is embodied as being formed to generally correspond to the cup holders 21, the carrier 38 may include any suitable structure that positions the filter 36 in line with the sensor unit 32 so that the filter 36 manipulates the sensor beam 33 and retrofits the system 10 for use with relatively transparent cups 12. For example, the carrier may include a plate or panel coupled to the cup holders 21 or a structure that corresponds to the sensor unit 32 and is coupled to the track 19 or the sensor unit 32.

The coating 40 is formed from a composition including a metallic base. In some embodiments the metallic base includes at least one of aluminum, nickel, chrome, tin, gold, or any suitable platable material. The coating 40 is deposited on an outer surface 42 of the carrier 38 that faces toward the sensor unit 32. The coating 40 is deposited on the outer surface 42 using a physical or plasma vapor deposition (PVD) process called magnetron sputtering. During this process, high voltage inside a vacuum chamber ionizes the Argon gas and accelerates the charged Argon particles toward a metal target using a magnetic field to concentrate the charged Argon particles at the metal target. The particles collide with the target to eject atoms of the metal. The metal vapor condenses on the outer surface 42 of the carrier 38 to provide the coating 40 on the carrier 38. The coating 40 is placed on the outer surface 42 so as to protect the coating from being damaged or removed as containers 12 are placed in and removed from container holders 21.

The sensor unit 32 is an optical sensor unit configured to emit a light emitting diode (LED) source such as the Ultra-slim Photoelectric Sensor EX-10 Ver. 2 sensor unit manufactured by Panasonic®. The sensor unit 32 includes an emitter 44 configured to emit the sensor beam 33, or LED source 33, and a receiver 46 aligned with the emitter 44 as shown in FIGS. 2 and 3. The receiver 46 receives the sensor beam 33 through the filter 36 when no cup is present in the cup holder 21. During testing of a retrofitted system 10 with the filter 36, the coating 40 including the aluminum unexpectedly interacted the sensor beam 33 and blocked the sensor beam 33 from reaching the receiver 46 while a relatively transparent cup 12 was present in the cup holder 21. Surprisingly, the filter 36 was also able to block the sensor beam 33 without the coating 40 in some instances.

Figure 4:
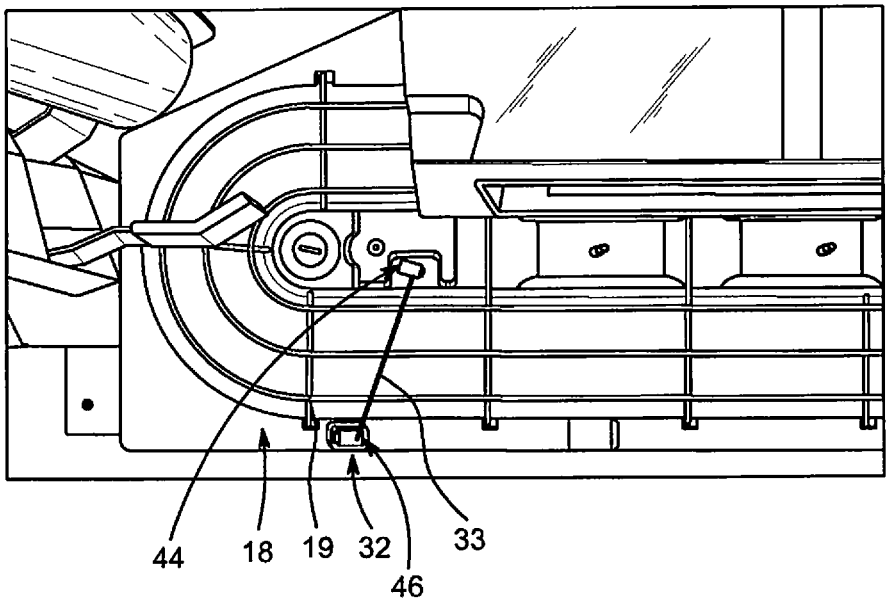
FIG. 4 is a top perspective view of a portion of the product-dispenser system from FIG. 1 showing a sensor unit positioned at the sensing station along the predetermined path and configured to emit a sensor beam that crosses the predetermined path to determine if the container holders are empty.
Figure 5:
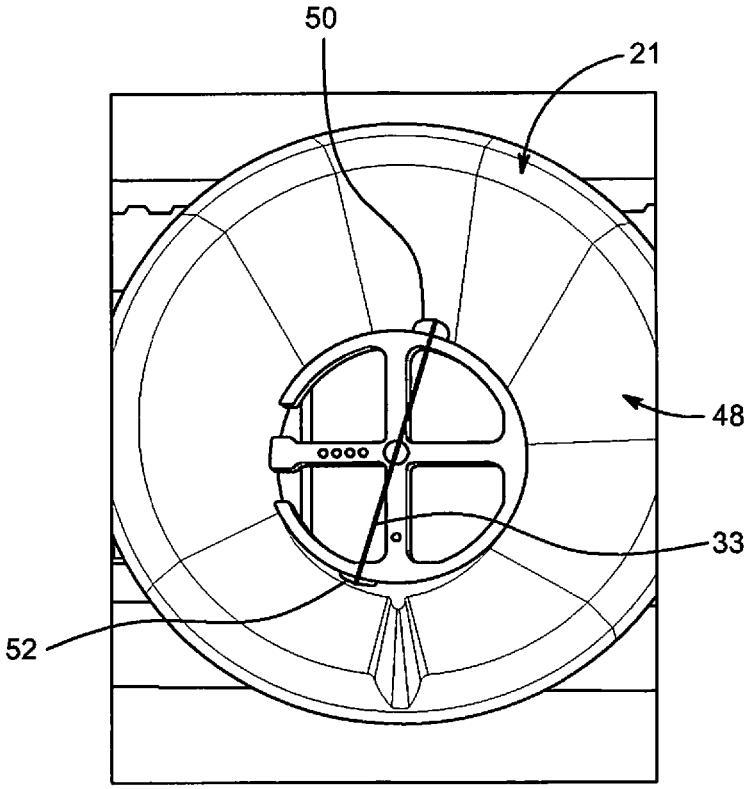
FIG. 5 is a perspective view of a portion of the sensor unit and a portion of a container holder at the sensor station where the sensor unit is configured to determine if the container holder is empty.
Figure 6:
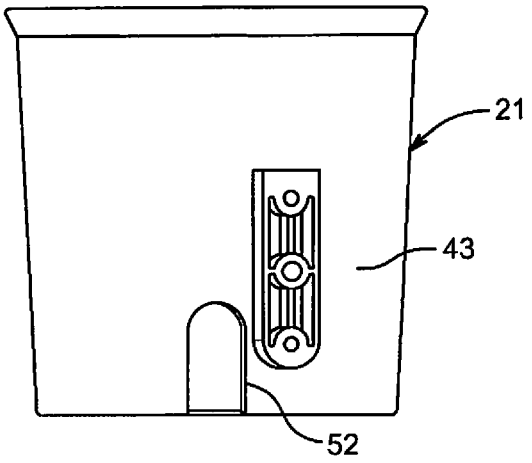
FIG. 6 is a side elevation view of a container holder from FIG. 1 showing that the container holder is formed to include at least one side aperture formed in a side wall of the container holder.
Figure 7:
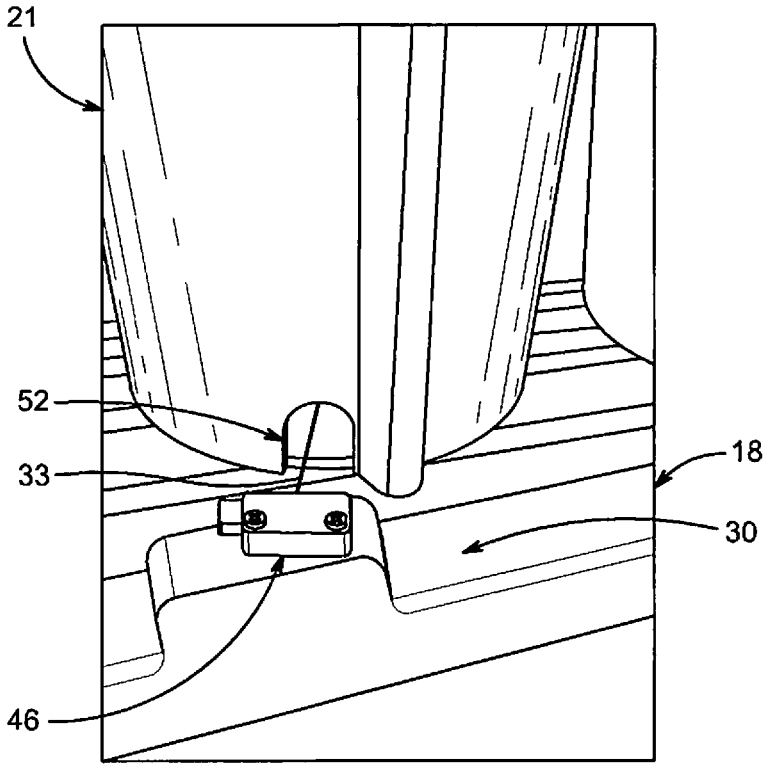
FIG. 7 is a top perspective view of the container holder of FIG. 1 showing that the container holder is formed to include a first side aperture and a second side aperture aligned with the first side aperture and suggesting that the sensor beam is configured to pass through the first and second side apertures.

The sensor unit 32 is coupled to the conveyor 18 in a fixed location as shown in FIG. 4. The emitter 44 and the receiver 46 are positioned on opposite sides of the track 19 such that the sensor beam 33 is sent across the track 19 as the cup holders 21 travel along the predetermined path 24. Each of the cup holders 21 includes a side wall 48 that is formed to include first and second side apertures 50, 52 formed in the side wall 48 as shown in FIGS. 5-7. The sensor beam 33 is emitted through the first and second side apertures 50, 52 when the cup holder 21 is located at the sensing station 30 to determine if a cup 12 is present in the cup holder 21. The filter 36 is inserted into the cup holder 21 to position the coating 40 adjacent to the first and second side apertures 50, 52 and in line with the sensor beam 33 when the cup holder is at the sensing station 30 as suggested in FIG. 8. The carrier 38 and the coating 40 cover the entire area of the first and second side apertures 50, 52.

The carrier 38 has a first height H1 and the side apertures have a second height H2 as shown in FIG. 3. In the illustrative embodiment, the first height H1 is greater than the second height H2 so that the coating 40 is provided over the entire face of the side apertures 50, 52. However, in another embodiment, the heights H1 and H2 may be equal. Alternatively, the coating 40 may be disposed on the carrier 38 with a height H3 as suggested in FIG. 9.

Figure 8:
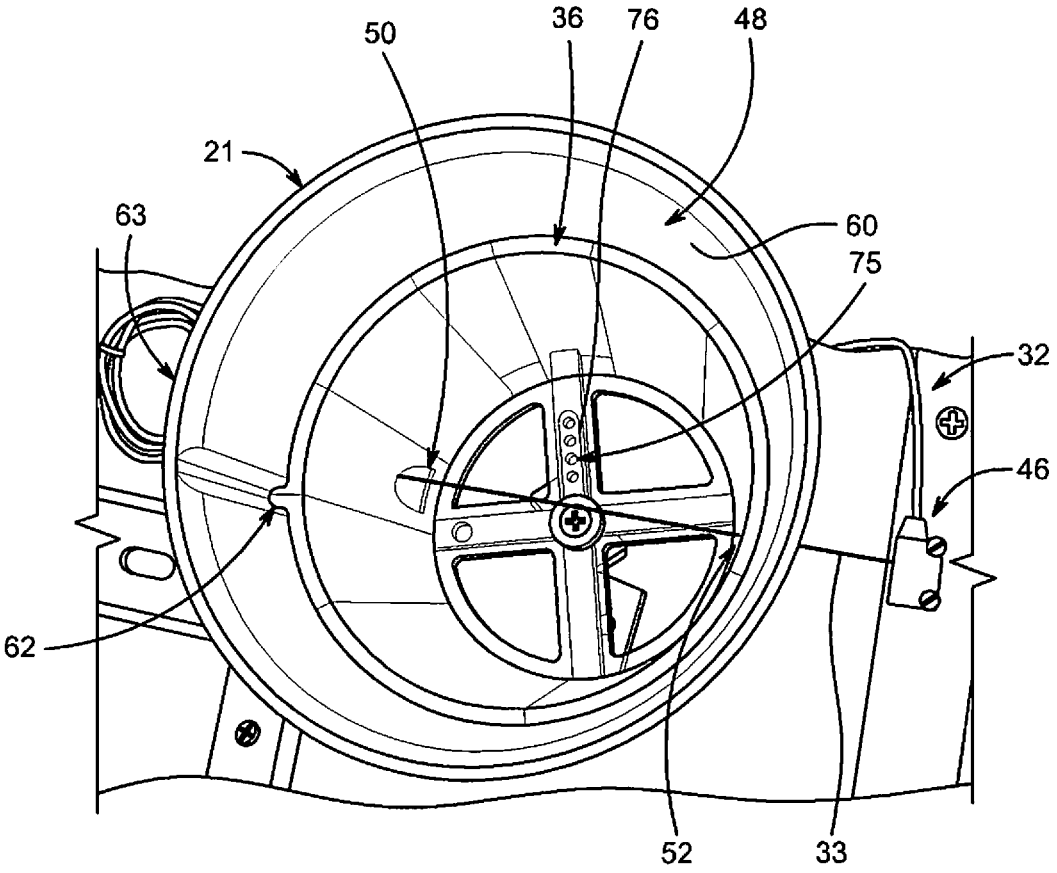
FIG. 8 is a top perspective view of the container holder of FIG. 7 with the filter positioned in the container holder between each of the side apertures.

In the illustrative embodiment, the carrier 38 includes a floor 54, a side wall 56 that extends upwardly away from the floor 54 generally along a longitudinal axis 55, and a brim 58 spaced apart from the floor 54 as shown in FIGS. 9-14. The side wall 56 of the carrier 38 is spaced apart radially from the side wall 48 of the cup holder 21 so that the outer surface 42 of the carrier 38 is spaced apart from an inner surface 60 of the cup holder 21 as shown in FIG. 8. The brim 58 flares radially outward from the side wall 56 and engages the inner surface 60 of the cup holder 21 to provide the spacing between the side wall 56 of the carrier 38 and the side wall 48 of the cup holder 21. The spacing between the side wall 56 of the carrier 38 and the side wall 48 of the cup holder 21 help protect the coating 40 on the outer surface 42 of the carrier 38 as the filter 36 is inserted and removed from the cup holder 21. Additionally, the brim 58 blocks fluids or objects from entering the space between the cup holder 21 and the filter 36 and removing or damaging the coating 40.

In the illustrative embodiment, the coating 40 is deposited on the entire outer surface 42 of the carrier 38. In another example, the coating 40 is deposited at select locations 43 on the outer surface 42 that correspond to where the sensor beam 33 interacts with the filter 36. The carrier 38 may further include a location feature 62 that orients the filter 36 relative to the cup holder 21 and positions the select locations 43 of the coating 40 directly in line with the side apertures 50, 52 formed in the side wall 48 of the cup holder 21. In the illustrative embodiment, the location feature 62 is a tab that is formed integral with the brim 58 of the carrier 38. The location feature 62 is shaped to correspond to a recess 63 in the side wall 48 of the cup holder 21 as shown in FIG. 8. In other embodiments, the location feature 62 may be formed on other parts of the carrier 38 such as the side wall 56 or the floor 54 and may include other structures such as a rib, key, notch, or any other suitable structure for orienting the filter 36 relative to the cup holder 21.

Figure 9:
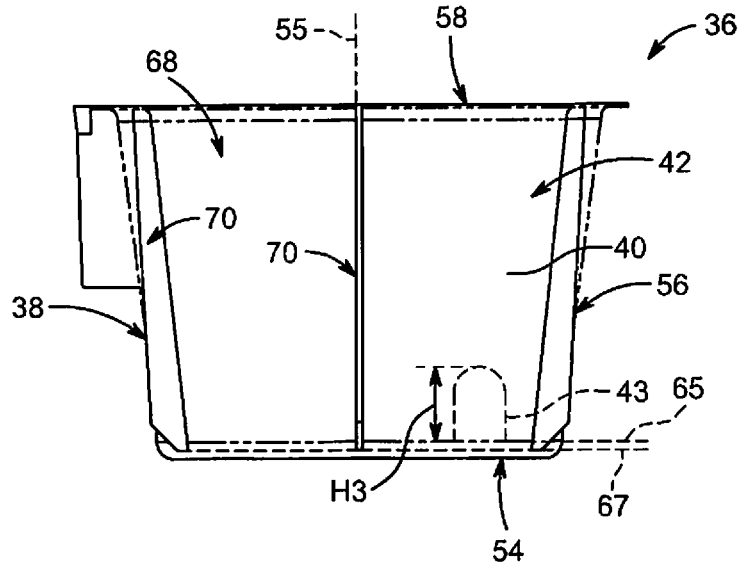
FIG. 9 is a side elevation view of the filter.
Figure 10:
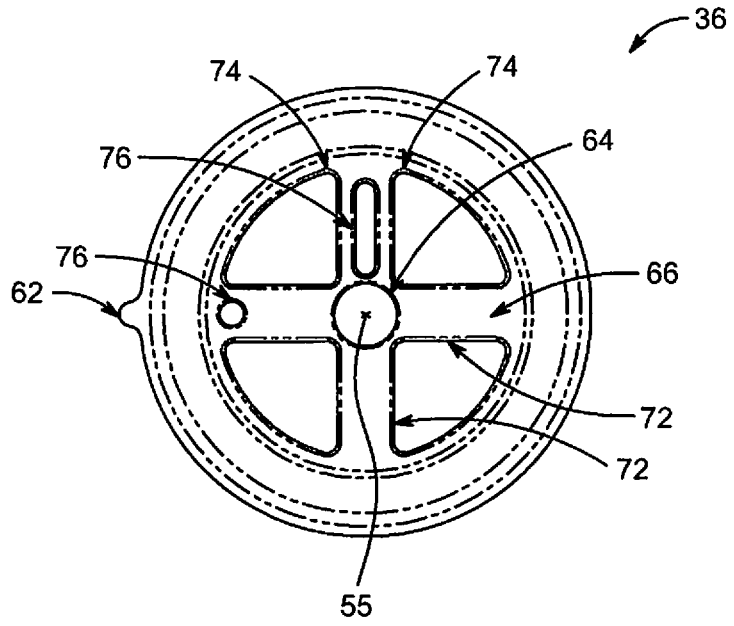
FIG. 10 is a top plan view of the filter.
Figure 13:
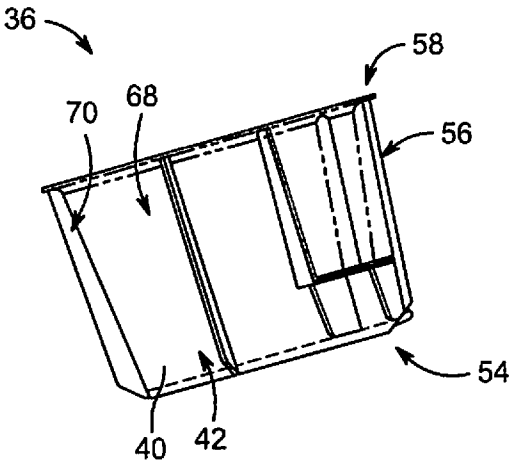
FIG. 13 is another perspective view of the filter.
Figure 12:
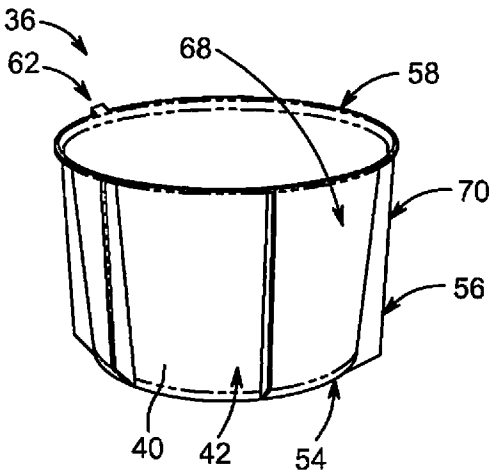
FIG. 12 is another perspective view of the filter.
Figure 14:
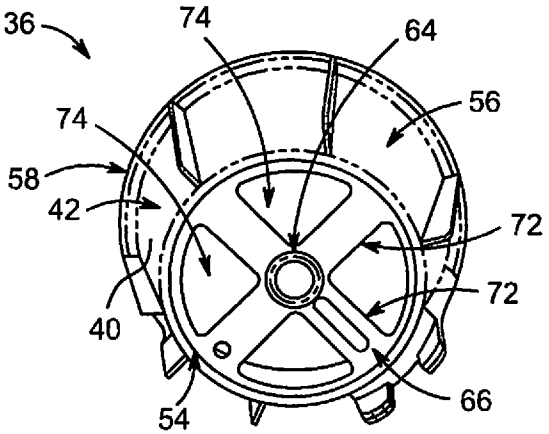
FIG. 14 is a bottom perspective view of the filter.
Figure 11:
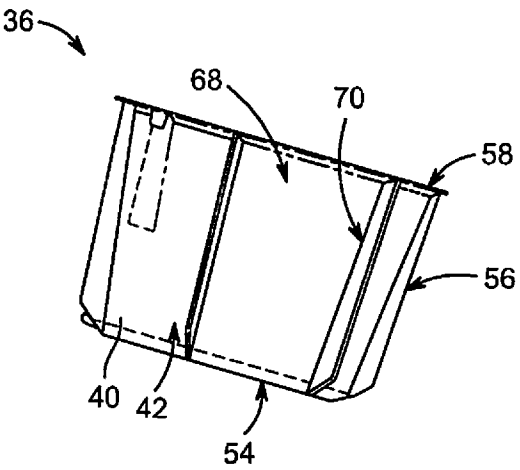
FIG. 11 is a perspective view of the filter.

The floor 54 of the carrier 38 includes raised disc 64 located at a center of the floor 54 and a peripheral section 66 radially outward from the raised disc 64 relative to the longitudinal axis 55 as shown in FIGS. 10 and 14. The raised disc 64 is circular and is at least partially offset vertically from the peripheral section 66. The raised disc 64 provides clearance for the cup 12 in the container holder 21. An upper portion of the raised disc 64 is arranged along a first plane 65 and the peripheral section 66 is arranged along a second plane 67 that is parallel to the first plane 65 as shown in FIG. 9. The first plane 65 is offset vertically from the second plane 67.

The peripheral section 66 includes a plurality of arms 72 that extend from the raised disc 64 radially outward to the side wall 56. A plurality of peripheral openings 74 are defined between the arms 72 and positioned circumferentially around the axis 55. The peripheral openings 74 allow liquid and/or ice to pass therethrough and out of the container holder 21. A plurality of apertures 76 may be formed in the peripheral section 66 to facilitate installation and removal of the filter 36 in the cup holder 21. The apertures 76 correspond to apertures 75 formed in the cup holder 21 so that the cup 12 may clear the container holder 12 and level the cup 12 in the container holder 21.

The side wall 56 includes an annular panel 68 and a plurality of ribs 70 as shown in FIGS. 9-14. The annular panel 68 extends circumferentially around the longitudinal axis 55 and has an inner surface 69 that faces the longitudinal axis 55 and engages the cup 12, when a cup is present. The plurality of ribs 70 are coupled to the outer surface 42 of the carrier 38 and extend radially outward from the outer surface 42 toward the side wall 48 of the cup holder 21. The ribs 70 are spaced apart from one another circumferentially around the annular panel 68 and engage the inner surface 60 of the side wall 48 to provide additional support for the filter 36 within the cup holder 21.

Figure 15:
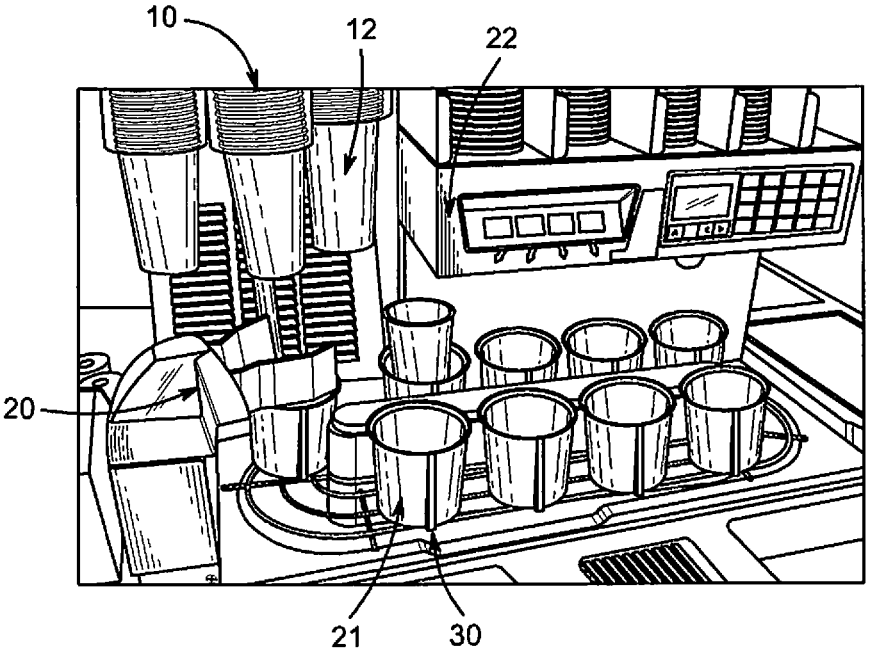
FIG. 15 is a perspective view of the automatic container loading and filling system of FIG. 1 with a container holder positioned at the sensing station.

A process for sensing and loading a cup 12 into one of the cup holders 21 is shown in FIGS. 15-18. The cup holder 21 is positioned on the track 19 at the sensing station 30 as shown in FIG. 15. There, the sensor unit 32 emits that sensor beam 33 through the side apertures 50, 52 in the cup holder 21 and the filter 36 to determine if a cup 12 is present in the cup holder 21. The sensor unit 32 sends the sensor signal to the controller 34 because there is no cup present in the cup holder 21. The controller 34 then sends a command signal to the cup loader 20 to dispense a cup 12 when the cup holder 21 reaches the loading station 26.

Figure 16:
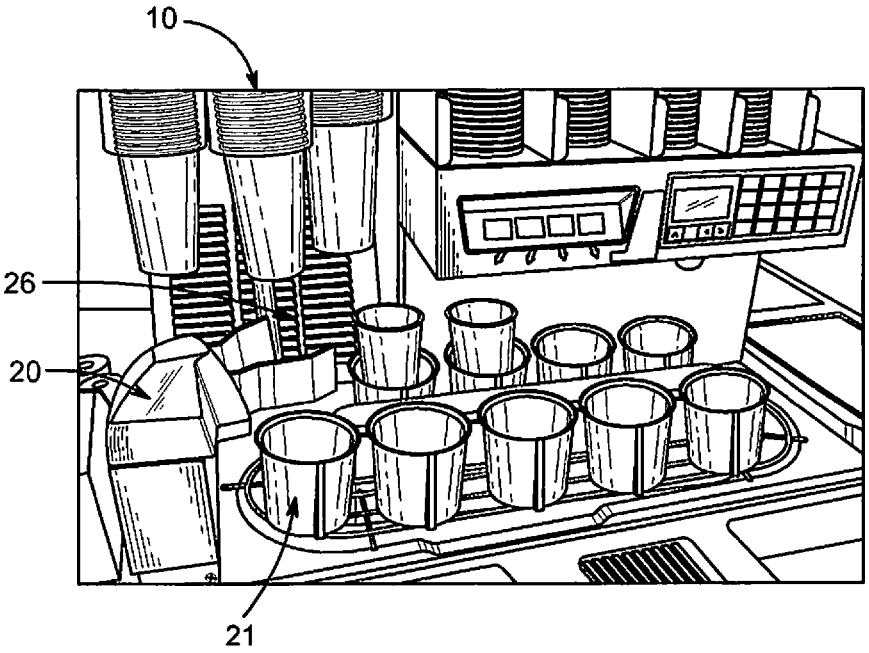
FIG. 16 is a perspective view of the system of FIG. 15 suggesting that the container is moving toward the loading station.
Figure 17:
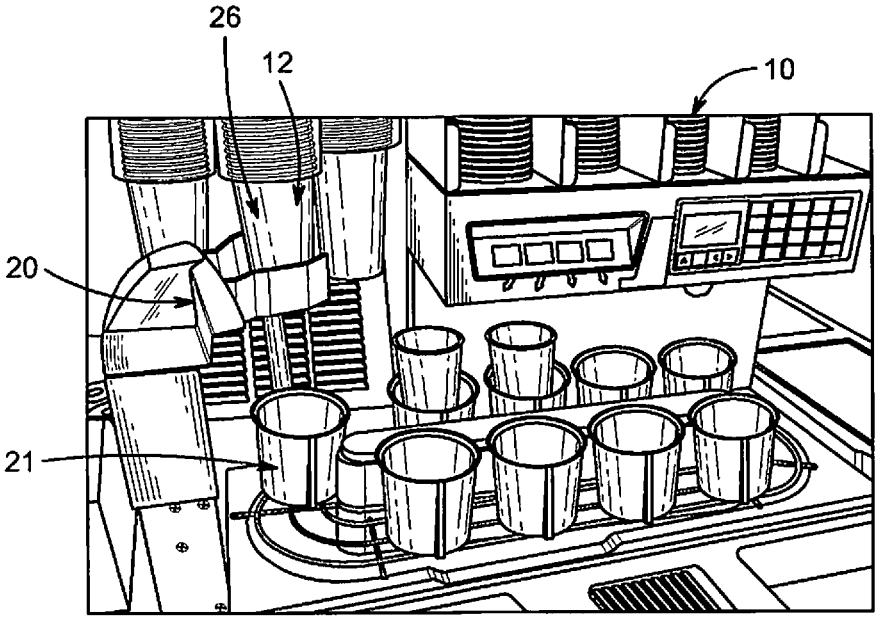
FIG. 17 is a perspective view of the system of FIGS. 15 and 16 with the container holder positioned at the loading station and a loading arm retrieving a container for placement in the empty cup holder.
Figure 18:
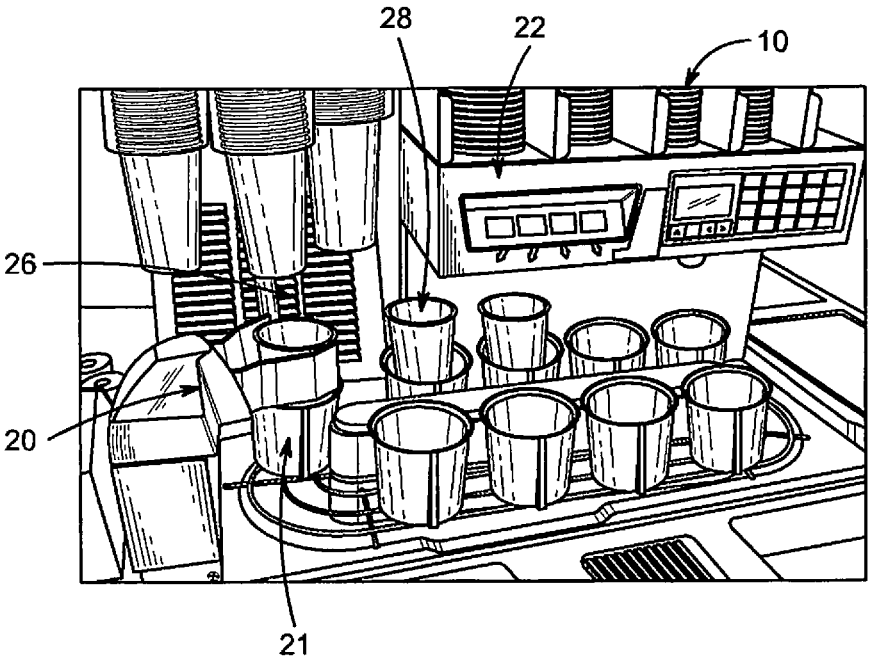
FIG. 18 is a perspective view of the system of FIGS. 15-17 showing the container being placed into the container holder.

The cup holder 21 travels along the predetermined path 24 defined by the track 19 toward the loading station 26 as shown in FIG. 16. Once at the loading station 26, the cup loader 20, having received the command signal from the controller 34, retrieves and dispenses a cup 12 into the cup holder 21 as shown in FIGS. 17-18. The cup holder 21 then carries the cup 12 from the loading station 26 to the filling station 28 where the cup filler 22 is programed to dispense the product into the cup to provide the final package as suggested in FIG. 18. In the illustrative embodiment, the cup loader 20 is a robotic arm that is movable to grasp a cup 12 and drop the cup into the cup holder 21. In other embodiments, the cup loader 20 may drop a cup into the cup holder 21 without using a robotic arm.

Figure 19:
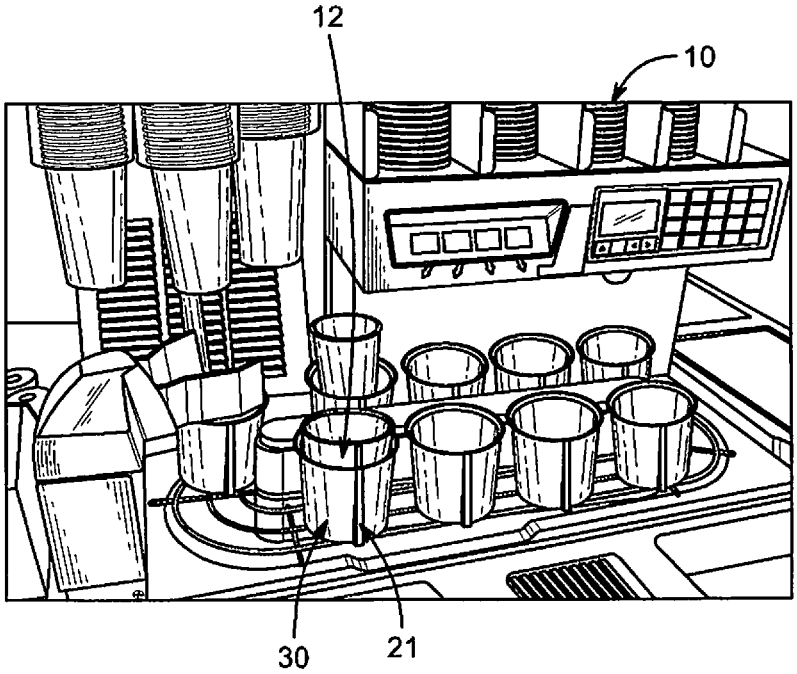
FIG. 19 is a perspective view similar to FIG. 15 except a container, for example a cup, is already present in the cup holder at the sensing station and suggesting that the sensor unit has determined that a cup is in the container holder.

In some situations, a cup 12 and/or final package may already be present in the cup holder 21 at the sensing station 30 as suggested in FIG. 19. In this situation, the receiver 46 of the sensor unit 32 will not receive the sensor beam 33 emitted by the emitter 44 due to interference with the cup 12. Accordingly, no sensor signal is sent to the controller and no command signal is sent to the cup loader 20 to cause the cup loader 20 to dispense a cup at the loading station 26 and prevent more than one cup from being placed into cup holder 21. In one example, the filter 36 is configured to interfere with the sensor beam 33 so that a transparent cup 12 limits the sensor beam 33 reaching the receiver 46. In another example, the filter 36 cooperates with a cup 12 to filter the sensor beam to limit the sensor beam reaching the receiver 46.

In another example, the transparent container further includes a graphics layer coupled to an external surface of the transparent container. The graphics layer may be paint, ink, combinations thereof, or any other suitable alternative. In one example, a container including graphics used in a container-filling system lacking the filter does not cause the sensor beam to be deflected even when the sensor beam is arranged to pass through the graphics layer. The container including graphics used in a container-filling system including the filter does cause the sensor beam to be deflected.

EXAMPLES

The following examples are set forth for purposes of illustration only. Parts and percentages appearing in such examples are by weight unless otherwise stipulated. All ASTM, ISO, and other standard test methods cited or referred to in this disclosure are incorporated by reference in their entirety.

Example 1

Formulation and Extrusion

An exemplary single-layer sheet in accordance with certain aspects of the present disclosure is provided in the instant example. The sheet in this example is a single-layer sheet.

A polymeric mixture comprised a polypropylene homopolymer, a polypropylene impact copolymer, and a polypropylene random copolymer. The polypropylene homopolymer was Ineos H02C-00. The polypropylene impact copolymer was LyondellBasell Pro-Fax™ SC204. The polypropylene random copolymer was LyondellBasell SR257. The percentages by weight of the components were about:

| | |
|---|---|
| 85% | Ineos H02C-00 |
| 5% | LyondellBasell Pro-fax ™ SC204 |
| 10% | LyondellBasell Pro-fax ™ SR257M |

The polypropylene homopolymer, the polypropylene impact copolymer, and the polypropylene random copolymer were added to an extruder hopper and combined via blending to provide a formulation. The formulation was then heated in the extruder to form a molten material. The molten material was extruded to form a single-layer sheet. The single-layer sheet was thermoformed to form a transparent cup in accordance with the present disclosure.

The invention claimed is:

1. A container-filling system comprising a product-dispenser system including a conveyor defining a predetermined path and a plurality of container holders coupled to the conveyor and configured to travel along the predetermined path, the predetermined path including a sensing station and a loading station, a control system including a sensor unit configured to emit a sensor beam toward at least one of the container holders at the sensing station to generate a sensor signal associated with an empty container holder and a controller coupled to the sensor unit and configured to send a command signal to the product-dispenser system to deliver a container to the at least one container holder upon receipt of the sensor signal, and a filter coupled to the at least one container holder and configured to filter the sensor beam at the sensing station so that the sensor signal is generated when no containers are present in the container holder to cause the controller to send the command signal to the conveyor unit to provide the container in the empty cup holder at the loading station.

2. The system of claim 1, wherein each of the container holders is formed to include first and second side apertures and the sensor beam travels along an axis through the first and second side apertures to generate the sensor signal at the sensing station and at least a portion of the filter is positioned in the path.

3. The system of claim 2, wherein the filter includes a side wall extending circumferentially around a longitudinal axis.

4. The system of claim 3, wherein the side wall has a first height and the first and second side apertures have a second height that is less than the first height.

5. The system of claim 3, wherein the side wall has a first height and the first and second side apertures have a second height that is equal to or less than the first height.

6. The system of claim 2, wherein the filter includes a floor, a side wall extending upwardly from the floor along a longitudinal axis, and a brim coupled to the side wall and spaced apart from the floor along the axis.

7. The system of claim 5, wherein the filter includes a carrier and a coating disposed on the carrier in line with the side apertures.

8. The system of claim 6, wherein the filter includes a plurality of ribs coupled to the side wall and spaced circumferentially around the longitudinal axis.

9. The system of claim 6, wherein the floor includes a raised disc and a peripheral section spaced radially from the raised disc and the raised disc is offset vertically from the peripheral section.

10. The system of claim 9, wherein the peripheral section includes a plurality of arms that extend from the raised disc to the side wall and a peripheral opening is formed between each of the arms.

11. The system of claim 1, wherein the filter includes a location feature that engages the cup holder to orient the filter relative to the cup holder.

12. The system of claim 11, wherein the location feature includes a tab formed on the filter and a slot formed in the cup holder and the tab is sized to fit in the slot.

13. The system of claim 1, wherein the container holder has a first height and the filter has a second height less than the first height.

14. A container-filling system comprising at least one container holder, a sensor unit configured to emit a sensor beam toward the at least one container holder and generate a sensor signal when a container is absent from the container holder, and a filter coupled to the at least one container holder and configured to filter the sensor beam so that the sensor beam is blocked when a transparent container is present in the cup holder, wherein the container holder has a first height and the filter has a second height less than the first height.

15. The system of claim 14, further comprising a product-dispenser system including a conveyor defining a predetermined path having a sensing station and a loading station and a container loader configured to provide a container at the loading station, and wherein the container holder is coupled to the conveyor and is configured to travel along the predetermined path from the sensing station, where the sensor unit is configured to determine if a transparent container is present, to the loading station, where the container loader is configured to provide a container if the sensor signal is generated.

16. The system of claim 14, wherein the filter includes a location feature that engages the cup holder to orient the filter relative to the cup holder.

17. The system of claim 14, wherein the filter includes a floor, a side wall extending upwardly from the floor along a longitudinal axis, and a brim coupled side wall and spaced apart from the floor along the axis.

18. The system of claim 17, wherein the filter further includes a plurality of ribs coupled to the side wall and spaced circumferentially around the longitudinal axis.

19. The system of claim 17, wherein the floor includes a raised disc and a peripheral section spaced radially from the raised disc and the raised disc is offset vertically from the peripheral section.

20. The system of claim 19, wherein the peripheral section includes a plurality of arms that extend from the raised disc to the side wall and a peripheral opening is formed between each of the arms.

* * * * *